US005216204A

United States Patent [19]

Dudek et al.

[11] Patent Number: 5,216,204

[45] Date of Patent: Jun. 1, 1993

[54] STATIC DISSIPATIVE ELECTRICAL CABLE

[75] Inventors: Thomas J. Dudek, Poughkeepsie; Edward C. Hallee, Wappingers Falls; Benedicto U. Messina, Poughkeepsie; Basil D. Washo, Poughkeepsie; Joel A. Weiner, Poughkeepsie, all of N.Y.

[73] Assignee: International Business Machines Corp., Armonk, N.Y.

[21] Appl. No.: 739,537

[22] Filed: Aug. 2, 1991

[51] Int. Cl.[5] ..... H01B 7/34

[52] U.S. Cl. ..... 174/102 SC; 174/36; 174/105 SC; 174/106 SC; 174/115

[58] Field of Search ..... 174/102 SC, 106 SC, 174/106 R, 105 SC, 105 R, 115, 36, 34

[56] References Cited

U.S. PATENT DOCUMENTS

| | | | |
|---|---|---|---|
| 3,355,544 | 11/1967 | Costley et al. | 174/106 R |
| 3,735,025 | 5/1973 | Ling et al. | 174/120 SC |
| 4,196,464 | 4/1980 | Russel | 361/215 |
| 4,347,487 | 8/1982 | Martin | 174/36 X |
| 4,422,483 | 12/1983 | Zins | 139/420 R |
| 4,469,539 | 9/1984 | Wade et al. | 174/105 SC X |
| 4,498,116 | 2/1985 | Saurenman | 361/213 |
| 4,532,375 | 7/1985 | Weitzel et al. | 174/106 SC X |
| 4,777,324 | 10/1988 | Lee | 174/36 X |
| 4,965,412 | 10/1990 | Lai et al. | 174/106 SC X |
| 4,986,372 | 1/1991 | Ganssle | 174/106 SC |
| 5,039,999 | 8/1991 | VanDeusen | 174/36 |

FOREIGN PATENT DOCUMENTS 1051793 4/1979 Canada .

*Primary Examiner*—Morris H. Nimmo
*Attorney, Agent, or Firm*—Floyd A. Gonzalez

[57] ABSTRACT

A static dissipative electrical cable which eliminates the build-up of triboelectric charging by having a carbon loaded outer jacket which is a semiconductor for draining off triboelectric charges. In one embodiment, the jacket material is a 1 megohm/ft semiconductive extrudable Teflon polyfluorinated alkoxy (PFA) resin static-dissipative polymer of low carbon-black loading (3–4% by weight) having very stable electrical/mechanical properties against temperature excursions, thermal/environmental shock and aging. The cable is designed with a double-clad aluminum/mylar foil shield that allows electrical commoning between inner and outer clads of the foil and control of the interface between semi-conductive static-dissipative jacket and the foil shield to yield a jacket-to-ground wire resistance value between 100 kilo-ohms and 50 megohms. The latter insures adequate draining of triboelectric charges to ground, while maintaining a high resistance path to any ground loop current from neighboring cables or frame ground.

4 Claims, 1 Drawing Sheet

STATIC DISSIPATIVE ELECTRICAL CABLE

BACKGROUND OF THE INVENTION

The present invention relates to static dissipative electrical cables, and more particularly relate to electronic equipment signal cables which dissipate triboelectric charge.

It has been discovered that computer systems are very sensitive to static electricity or triboelectric charging on signal cables which can cause errors and system disruptions. These system disruptions are very undesirable in those systems wherein field system up-grades are being performed while keeping the system on-line and in large multiprocessing systems designed for continuous operation through parallel maintenance. It has been determined that standard high speed tri-lead logic cables show several hundred to several thousand volts residing on the cable jacket, which could persist for weeks on the cable while in the machine environment. Abrupt discharging of such voltages could cause system level disruptions.

Attempts in the past to discharge triboelectric charges on the cables has included the use of grounding straps on personnel handling the cables, or on the cables themselves. However, the grounding straps discharge only the spot on the cable they touch, and do not discharge voltages caused by triboelectric charging even a short distance away. Air ionizers have also been used in an attempt to dissipate triboelectric charges on the cables.

U.S. Pat. No. 4,498,116 issued Feb. 5, 1985 to Saurenman for Control of Static Neutralization Employing Positive and Negative ION Distributor discloses an apparatus to reduce static electricity in a work zone.

U.S. Pat. No. 4,422,483 issued Dec. 27, 1983 to Zins for Antistatic Fabric and Garment Made Therefrom discloses a garment for use in "clean rooms" in which conductive filaments in the fabric provide anti-static properties.

U.S. Pat. No. 4,196,464 issued Apr. 1, 1990 to Russell for Semi-Conductive Layer-Containing Reinforced Pressure Hose and Method of Making Same, and Canadian Patent No. 1051793 issued Apr. 3, 1979 to Johansen for Composite Paint Hose, both of which disclose hoses for conveying paint and include an electrically semi-conductive layer which serves as a ground for static electricity.

SUMMARY OF THE INVENTION

The present invention provides a static dissipative electrical cable which eliminates the build-up of triboelectric charging by having a carbon loaded outer jacket which is a semiconductor for draining off triboelectric charges. In one embodiment, the jacket material is a 1 megohm/ft semiconductive extrudable perfluoralkoxy (PFA) resin static-dissipative polymer of low carbon-black loading (3–4% by weight) having very stable electrical/mechanical properties against temperature excursions, thermal/environmental shock and aging. The cable is designed with a double-clad aluminum/mylar foil shield that allows electrical commoning between inner and outer clads of the foil and control of the interface between semi-conductive static-dissipative jacket and the foil shield to yield a jacket-to-ground wire resistance value between 100 kilo-ohms and 50 megohms. The latter insures adequate draining of triboelectric charges to ground, while maintaining a high resistance path to any ground loop current from neighboring cables or frame ground. A twisted pair embodiment and an embodiment having separate ground wires and drain wires are also disclosed.

It is therefore an object of the present invention to provide a signal cable which dissipates triboelectric charging on the cable.

It is also an object of the present invention to provide a signal cable which, while dissipating triboelectric changing, maintains a high resistance path of any ground loop currents.

It is also an object of the present invention to provide a signal cable which allows commoning between inner and outer clads of a double-clad aluminum/mylar foil shield which is wound around signal wires and in contact with a semi-conductive static-dissapative outer jacket of the signal cable.

These and other objects of the present invention will be apparent from the following more particular description of the preferred embodiment of the invention as illustrated in the drawings.

DESCRIPTION OF THE PREFERRED EMBODIMENT

Figure 1:
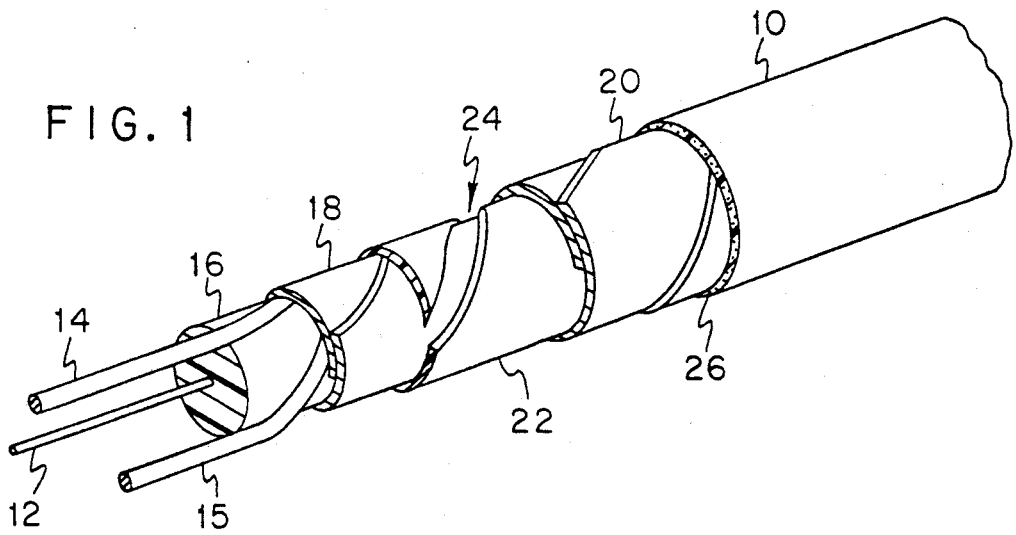
FIG. 1 is one embodiment of the present invention for a high speed tri-lead signal cable having a single signal conductor and a pair of drain wires.

FIG. 1 shows a high speed tri-lead signal cable 10 having a single center signal conductor 12 and a pair of drain wires 14 and 15. The signal conductor 12 is surrounded by a dielectric 16 such as expanded polytetrafluoroethylene (Teflon) to provide electrical insulation. The drain wires 14 and 15 are covered by a double-clad aluminum/mylar foil having in inner wrap of aluminum foil 18, an outer wrap of aluminum foil 20, and a spiral wrap of Mylar material 22 between the inner and outer aluminum wraps 18 and 20. The Mylar material 22 is spiral wrapped such that there is a gap 24 between each succeeding turn of the Mylar material to provide for electrical conduction or commoning between the outer aluminum wrap 20 and the inner aluminum wrap 18. The cable 10 is covered with a semi-conductive static-dissipative jacket 26. The jacket 26 may be made of extrudable perfluoroalkoxy (PFA) resin static-dissipative polymer of low carbon-black loading (3–4% by weight). The jacket material has very stable electrical/-mechanical properties against temperature excursion, thermal/environmental shock and aging. The carbon loading is such that the resistivity of the jacket 26 is from about 100 kilo-ohms to about 50 megohms to insure adequate draining of triboelectric charges to ground, while maintaining a high resistance path to any ground loop currents from neighboring cables or frame ground. The jacket 26 to drain wire 14 or 15 resistance is greater than 100 kilo-ohms when measured at 1.5 to 2.5 volts DC between a slit in the jacket 26 and a drain wire 14 or 15 at 0.3 m, and less than 50 megohms when measured at 20 to 30 volts DC. The jacket 26 may also be of any material having the described static dissipative characteristics, such as, for instance, carbon impregnated polyvinyl chloride (PVC) material. It will be understood that when the drain wires 14 or 15 are grounded in use, that triboelectric charges are drained off through the semiconductive jacket 26, the aluminum foil wraps 18 and 22, and the drain wires 14 and 15.

Figure 2:
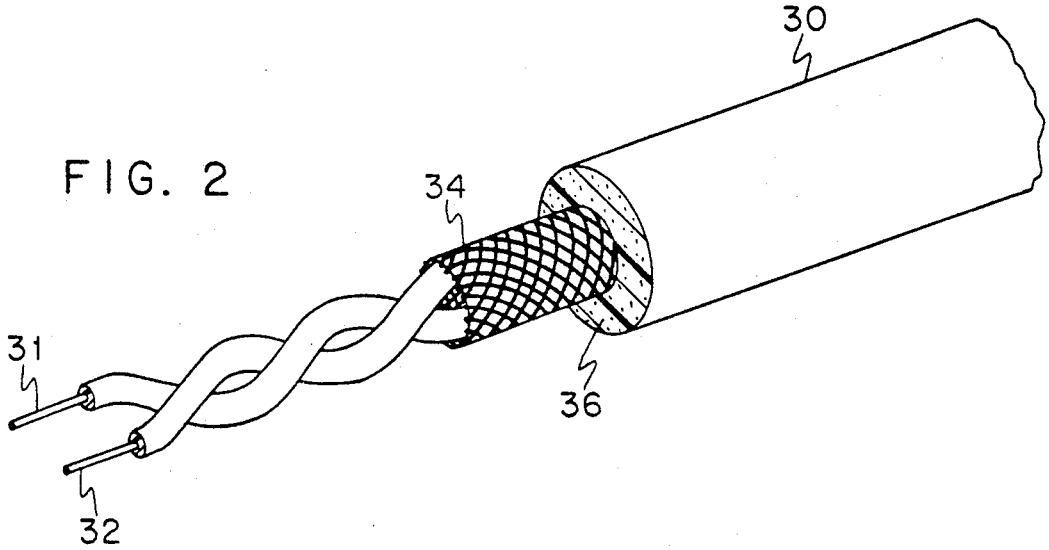
FIG. 2 is another embodiment of the invention for a signal cable having a twisted pair of signal conductors surrounded by a wire braid.

FIG. 2 shows a cable 30 having a twisted pair of signal conductors 31 and 32, each insulated by suitable insulative dielectric material. The twisted pair is surrounded by wire braid 34 to provide grounding. The outer jacket 36 is made of the same material as described in connection with the jacket 26 of FIG. 1 to provide static charge dissipative characteristics to the cable 30.

Figure 3:
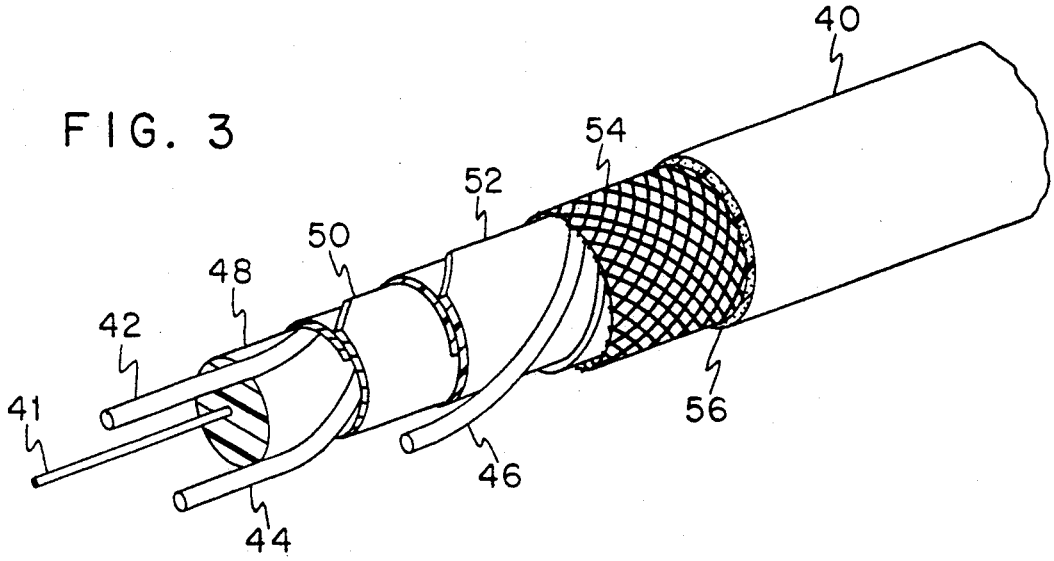
FIG. 3 is another embodiment of the invention for a signal cable having a single signal conductor, a pair of ground wires, and a drain wire.

FIG. 3 shows a cable 40 having a signal conductor 41, a pair of ground wires 42 and 44, and a drain wire 46. The signal conductor 41 is surrounded by a suitable dielectric material 48 to provide electrical insulation. The dielectric 48 and the ground wires 42 and 44 are surrounded by a foil wrap 50 to provide a shield to the signal conductor 41. The foil shield 50 is surrounded by an inner jacket 52 which may be of a Teflon material to insulate the ground wires 42 and 44. The drain wire 46 is spiral wound around the inner jacket 52, and is covered by an axially spiral wrapped wire braid 54. An outer jacket 56 covers the wire braid 54 and is made of the semiconductive material described in connection with the jacket 26 of FIG. 1 to provide static dissipative properties to the cable 40. The wire braid 54 and/or the drain wire 46 is appropriately grounded to drain off any triboelectric charge from the jacket 56.

While we have illustrated and described the preferred embodiments of our invention, it is to be understood that we do not limit ourselves to the precise construction herein disclosed, and the right is reserved to all changes and modifications coming within the scope of the invention as defined in the appended claims.

Having thus described our invention, what we claim as new, and desire to secure by Letters Patent is:

1. A static dissipative electrical cable comprising:

a conductor for conducting electrical signals;

an insulative layer surrounding said conductor;

an outer jacket including static dissipative material for providing continuity and dissipating triboelectric charges;

at least one drain wire spiral wrapped around said insulative layer;

an inner aluminum foil wrap around said insulative layer and said drain wire;

a Mylar strip spiral wrapped around said inner aluminum foil wrap, said Mylar strip wrapped in successive turns and having a gap between each successive turn of the Mylar strip; and an outer aluminum foil wrap around said Mylar strip and in electrical contact with said outer jacket and said inner aluminum foil wrap through said gap such that triboelectric charges may be drained from said outer jacket through said drain wire via said inner and outer aluminum wraps.

2. The static dissipative electrical cable of claim 1 wherein said outer jacket includes a semiconductive extrudable perfluoroalkoxy resin having about 3 to 4 percent by weight carbon-black loading.

3. The static dissipative electrical cable of claim 2 wherein the resistance between said outer jacket and said drain means is between about 100 kilo-ohms and 50 megohms.

4. A static dissipative electrical cable comprising:

a conductor for conducting electrical signals;

a first insulative layer surrounding said conductor;

an outer jacket including static dissipative material for providing continuity and dissipating triboelectric charges;

at least one ground wire spiral wrapped around said first insulative layer;

a second insulative layer covering said ground wire and the first insulative layer;

drain means between said second insulative layer and said outer jacket for draining triboelectric charges from said outer layer, said drain means including at least one drain wire spiral wrapped around said second insulative layer, and a wire braid axially spiral wrapped around said drain wire and said second insulative layer for draining triboelectric charges from said outer jacket.

* * * * *